United States Patent [19]

Gains et al.

[11] Patent Number: 4,807,824

[45] Date of Patent: Feb. 28, 1989

[54] PAPER ROLL TOWEL DISPENSER

[75] Inventors: Oliver B. Gains, La Verne; Jack L. Perrin, Santa Barbara; Council A. Tucker, Glendale, all of Calif.

[73] Assignee: James River II, Inc., Oakland, Calif.

[21] Appl. No.: 211,947

[22] Filed: Jun. 27, 1988

[51] Int. Cl.[4] ..... B65H 19/04; B65H 19/00

[52] U.S. Cl. ..... 242/55.3; 313/38

[58] Field of Search ..... 242/55.3, 55.53, 58, 242/58.1, 58.4; 312/38, 39

[56] References Cited

U.S. PATENT DOCUMENTS

| | | | |
|---|---|---|---|
| 2,930,664 | 3/1957 | Liebisch | 242/58 |
| 3,628,743 | 12/1971 | Bastin | 242/55.3 |
| 4,010,909 | 3/1977 | Bstin | 242/55.3 |
| 4,106,684 | 8/1978 | Hartbauer et al. | 242/55.3 |
| 4,165,138 | 8/1979 | Hedge et al. | 312/38 X |
| 4,358,169 | 11/1982 | Filipowicz et al. | 312/38 X |
| 4,378,912 | 4/1983 | Perrin et al. | 55.53 X/ |
| 4,756,485 | 7/1988 | Bastian et al. | 312/39 X |

*Primary Examiner*—Stuart S. Levy
*Assistant Examiner*—J. Eghtessad
*Attorney, Agent, or Firm*—Stanley M. Teigland

[57] ABSTRACT

This invention provides an improved web transfer mechanism in a paper roll towel dispenser of the type having a primary roll and a reserve roll of paper toweling. The transfer mechanism comprises a cradle for supporting the primary roll that is counterbalanced by an element for tucking the leading end of the reserve roll into the nip between feed rollers. As the primary roll becomes depleted, the counterbalancing force of the roll decreases, causing the tucking element to gradually approach the leading end of the reserve roll until the element finally engages the end and introduces it into the nip. In a preferred embodiment, the device includes a damper mechanism to prevent premature introduction of the leading end caused by the tendency of the primary roll to rise above the cradle by a sudden pull on the toweling.

2 Claims, 4 Drawing Sheets

PAPER ROLL TOWEL DISPENSER

BACKGROUND OF THE INVENTION

This invention is a device for dispensing sheet material sequentially from a primary roll and a reserve roll. Such devices are used in public restrooms for dispensing paper toweling from a roll.

As shown in U.S. Pat. Nos. 2,930,664 to Liebisch, 3,228,387 to Craven, 3,917,191 to Graham et al, 4,010,909 to Bastian, and 4,378,912 to Perrin et al, such devices comprise a cabinet having an opening through which the sheet material is dispensed, means for supporting the primary and reserve rolls, feed means including a pair of rolls forming a niP through which the sheet material passes, and means for introducing sheet material from the reserve roll into the nip responsive to depletion of primary roll sheet material. This invention provides improved means for introducing sheet material into the nip responsive to depletion of primary roll sheet material.

SUMMARY OF THE INVENTION

The improved device of this invention has a balanced lever mounted for rotational movement about a fulcrum. The portion of the lever to one side of the fulcrum comprises a cradle for supporting the primary roll and the portion of the lever to the other side of the fulcrum comPrises an element for tucking sheet material from the reserve roll into the nip. The lever is balanced such that when the cradle supports a primary roll that has not been substantially depleted, the tucking element is raised above the nip (inactive position) and when the primary roll has been substantially depleted, the tucking element is lowered to introduce sheet material from the reserve roll into the nip.

In a preferred embodiment, the device includes a damper mechanism to counteract the tendency of the primary roll to momentarily rise up in response to a sudden pull on the primary roll sheet material. The damper mechanism comprises a cam element that engages a cam follower. The cam is positioned so that as the primary roll attempts to rise up in response to a sudden pull on the primary roll sheet material, the cam engages the primary roll sheet material, with the result that the force of the sheet material is transferred to the cam fo11ower such that the tucking element is maintained in the raised position.

DETAILED DESCRIPTION

Figure 1:
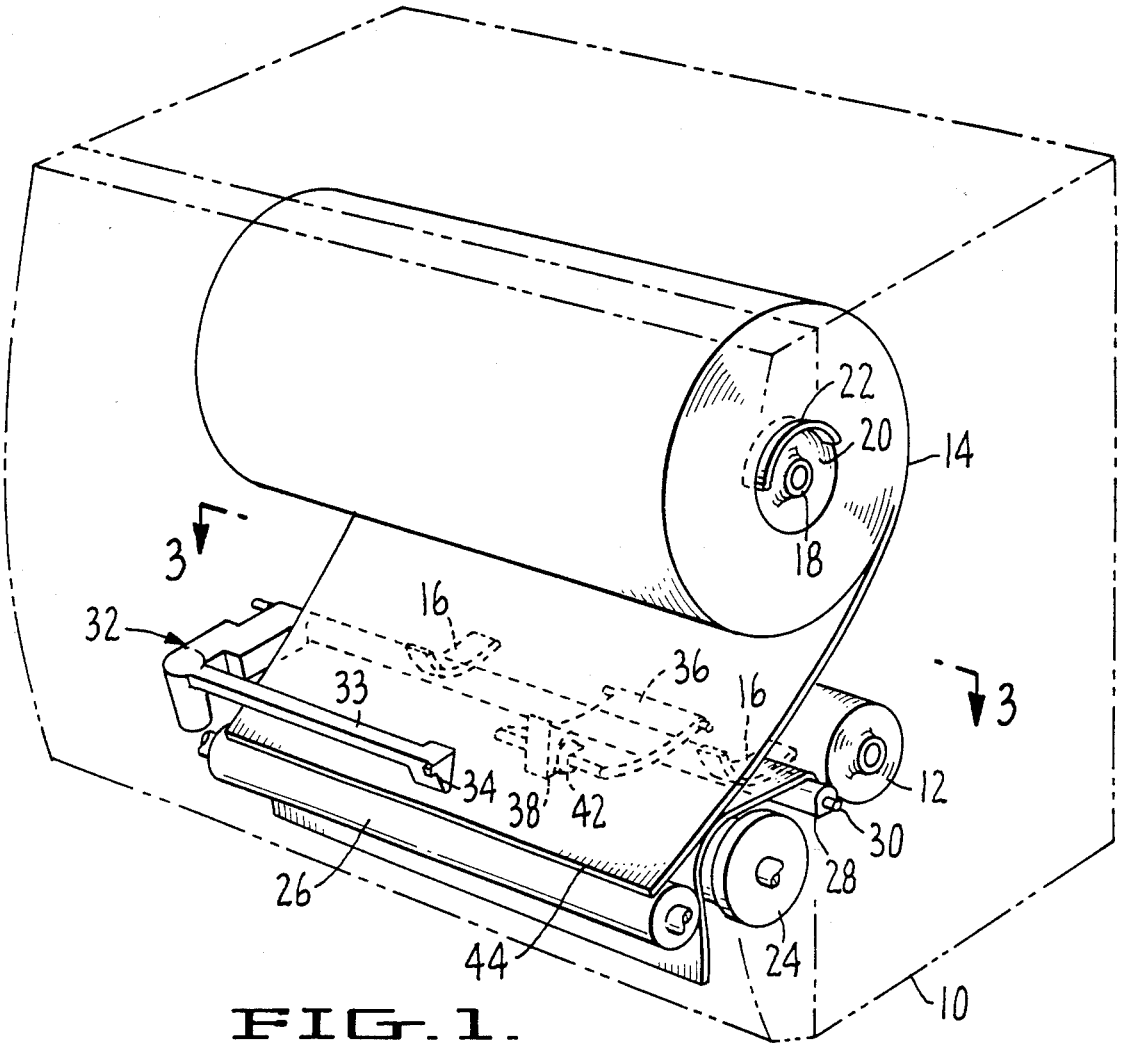
FIG. 1 is a perspective view of the improved device of this invention showing the primary and reserve rolls threaded in the device.

Referring to the drawings, the device of the invention includes a cabinet 10, which is shown in phantom in FIG. 1. Located within the cabinet 10 are a primary roll 12 and a reserve roll 14 of sheet material in the form of paper toweling. The primary roll 12 is supported on a cradle 16. The reserve roll 14 is preferably of the type shown in U.S. Pat. No. 3,038,598, being wound about a core 18 and having a bearing receptacle 20 formed in one end of the roll 14 to define a bearing wall of layers of paper toweling. A bearing member 22, mounted on the sidewall of the cabinet, projects inwardly to bearing receptacle 20 to support the reserve roll 14. The other end of the reserve roll is supported by a bearing mechanism (not shown) at the other side of the cabinet. When enough toweling has been removed for the bearing recepracle 20 to disappear, the partially depleted roll will fall down onto the cradle 16 to become the primary roll. In due course an attendant would open the cabinet and install a new reserve roll. However, the rolls may be of any type and need not have the above-described drop-down feature, in which case the attendant would manually remove the partially depleted roll and place it on the cradle before installing a new reserve roll.

Figure 2:
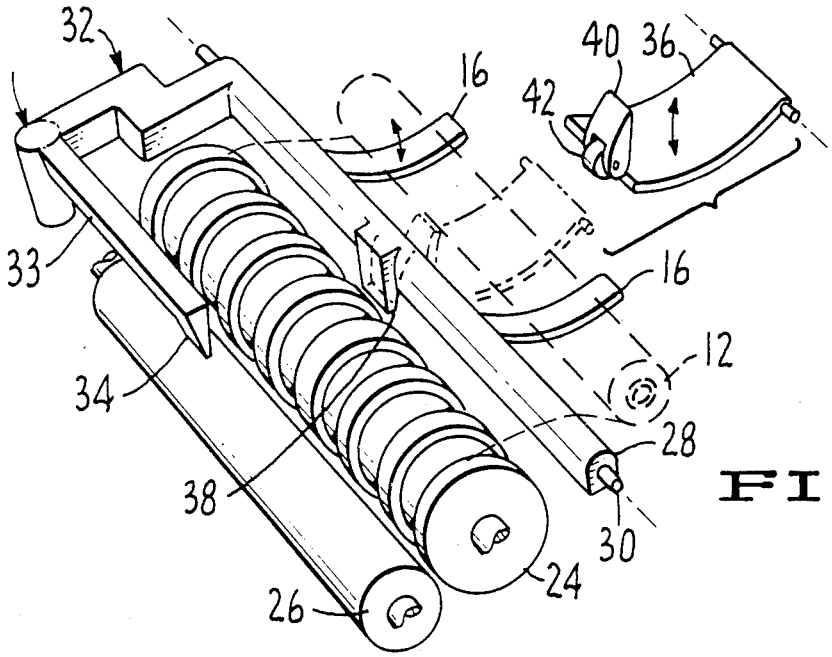
FIG. 2 is another perspective view showing detail of the device.
Figure 3:
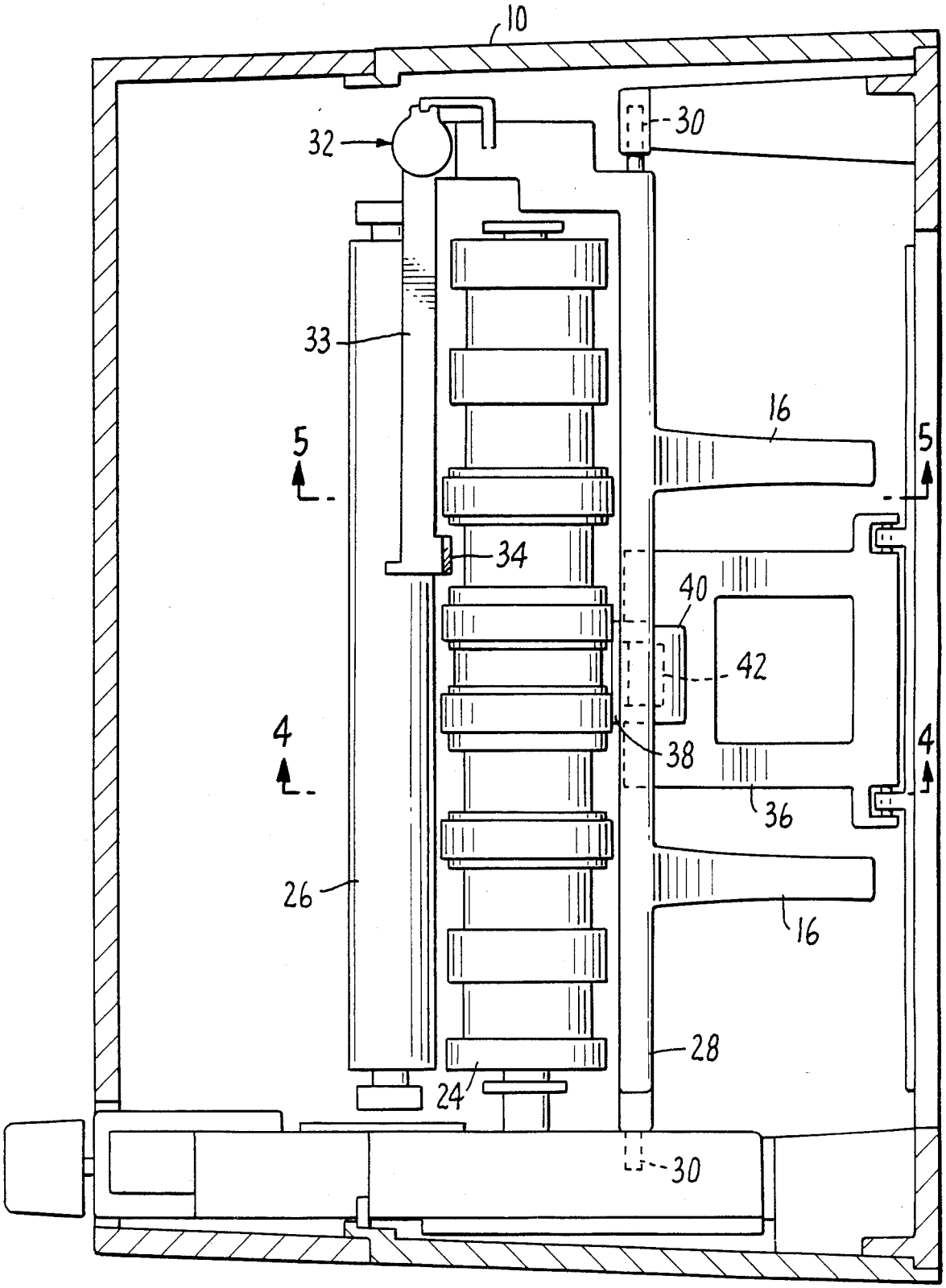
FIG. 3 is a sectional top view of the device taken along line 3—3.

As seen in FIG. 2, the device comprises feed means including a pair of selectively rotatable rollers 24, 26 which form a nip through which the sheet material is drawn upon rotation of the rollers. The rollers are mounted for rotation in sockets (not shown) at the sides of the cabinet. Mechanisms for rotating the rollers are well known and therefore are not illustrated.

The cradle 16 is affixed to a turning bar 28, which is supported for rotational movement by an axle 30, which is supported by sockets at the side walls of the cabinet. Also affixed to the turning bar 28 is an element 32 for tucking sheet material from the reserve roll into the nip between the rollers 24, 26. The tucking element includes an arm 33 having a tucker blade 34 positioned above the nip between the rollers 24, 26. The arm 33 is preferably mounted for pivotable movement. Together, the cradle 16 and the tucking element 32 form a seesaw-like lever that rotates about the axle 30, which is the fulcrum of the lever.

Figure 6:
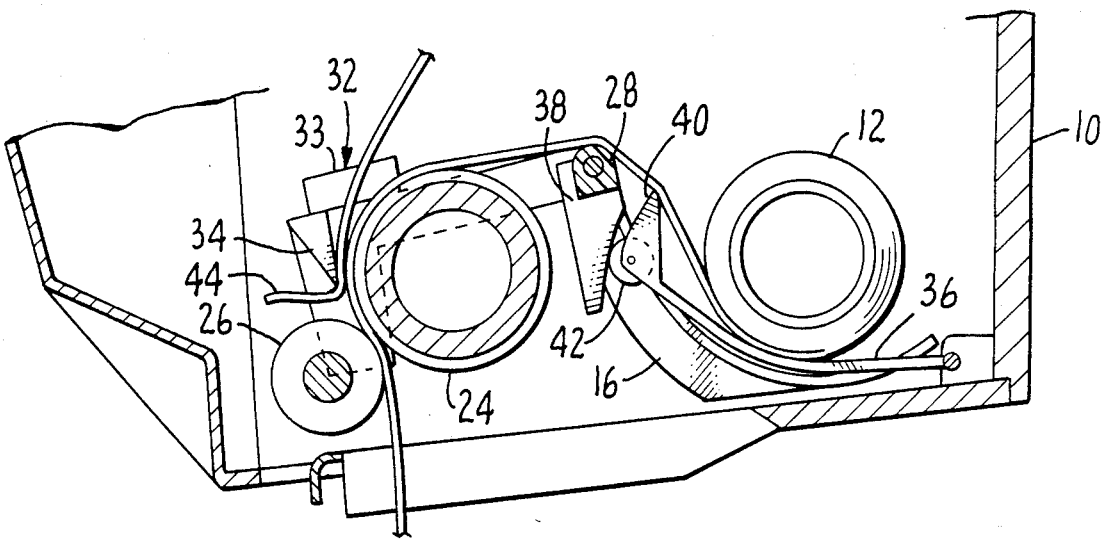
FIG. 6 is a side view showing the primary roll sheet material engaging the cam to maintain the tucking element in the raised position.

In a preferred embodiment, the device includes a damper mechanism comprising a cam 36 Pivotally mounted on the cabinet 10 and a cam follower 38 that engages the cam 36 and is affixed to the turning bar 28 for rotational movement with the tucking element. When the primary roll sheet material 1s dispensed by being pulled forward, the force of the sheet material acts against a projection 40 of the cam 36 and is transferred to the cam follower 38 by a roller 42 forming part of the cam 36. As shown in FIG. 6, the force of the sheet material or the cam follower keeps the tucking element raised above the nip, thereby preventing premature introduction of sheet material from the reserve roll into the nip.

Figure 4:
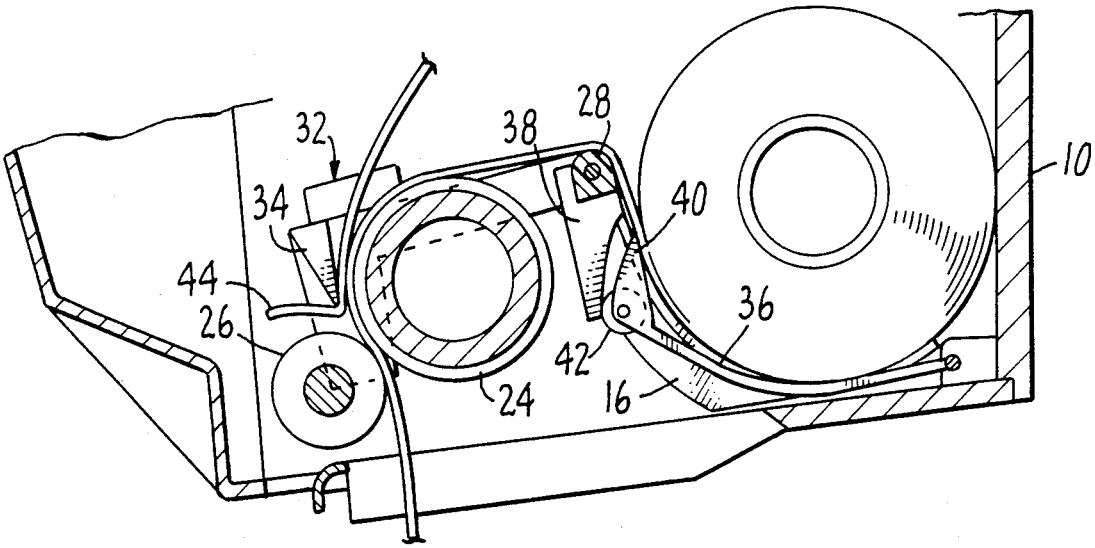
FIG. 4 is a sectional side view taken along line 4—4.
Figure 5:
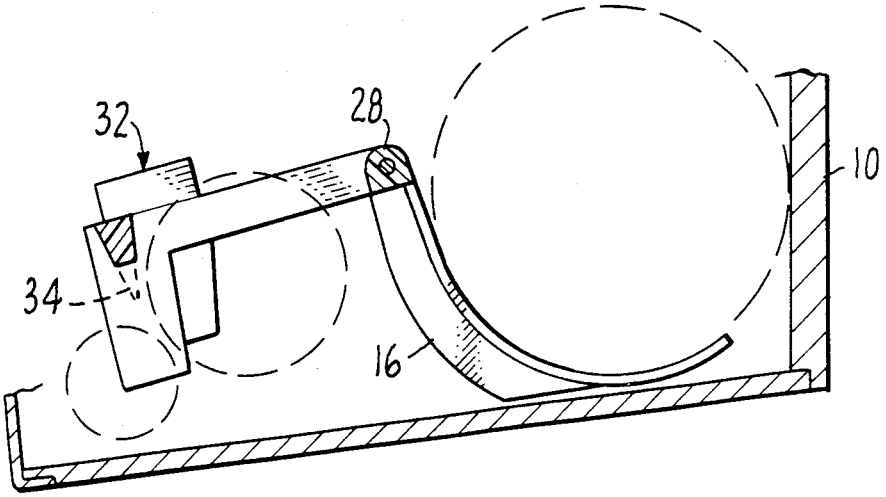
FIG. 5 is a sectional side view taken along line 5—5.
Figure 7:
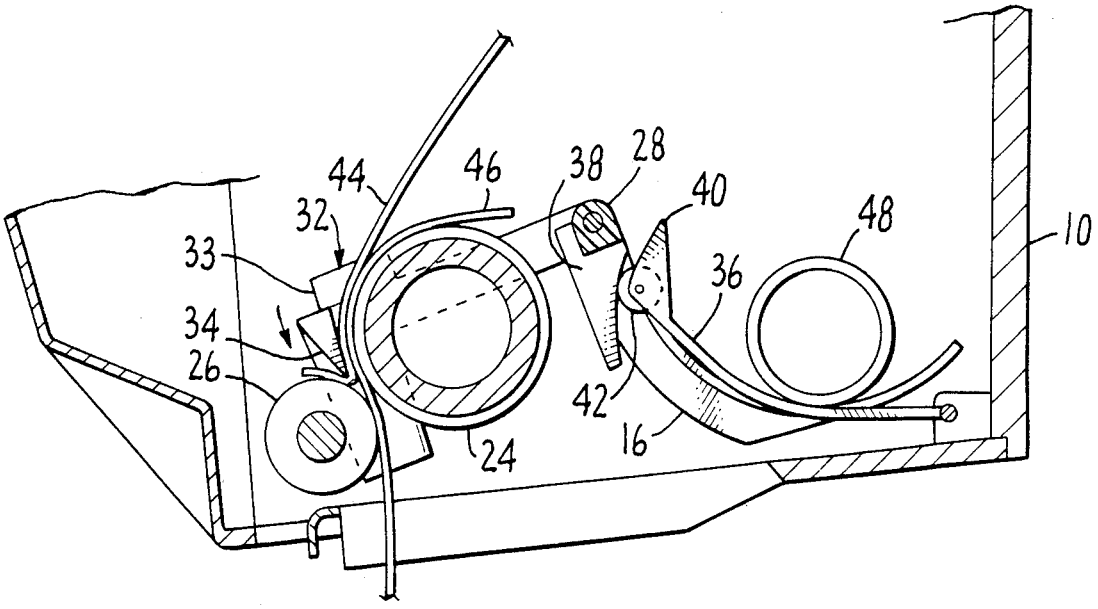
FIG. 7 is a side view showing the tucking element lowered to introduce sheet material from the reserve roll in response to depletion of primary roll sheet material.

In operation of the device, toweling dispensed from the primary roll passes first through the nip between rollers 24, 26 as best seen in FIG. 4. Prior to web transfer, the initial end of toweling 44 from the reserve roll will have been placed under the tucker blade 34. As the primary roll becomes depleted, the counterbalancing force of the roll decreases, causing the rucker blade 34 to lower until, when the roll is substantially depleted, the tucker blade engages the toweling 44 and introduces it into the nip, thereby starting the reserve roll of toweling when the primary roll is substantially depleted, as shown in FIG. 7, where the tail end 46 and core 48 of the primary roll can be seen.

A particular advantage of this invention compared to prior art devices is that it is much easier to install the reserve roll. In this invention the reserve roll is loaded, the arm 33 of the tucking element is pivoted clear, the reserve roll sheet material is pulled down in place, and the arm is repivoted. In contrast, in prior art devices, such as described in our U.S. Pat. No. 4,378,912, it was necessary to remove the primary roll sheet material from between the rollers, raise the sensing means, feed the sheet material udnder the sensing means, and re-thread the sheet material between the rollers. All of these steps, which were required before the reservse roll was loaded into the dispenser, are not required in this invention.

We claim:

1. In a device for dispensing sheet material sequentially from a primary roll and a reserve roll, the device comprising a cabinet having a slot through which the sheet material is dispensed, feed means including a pair of rollers defining a nip through which the sheet material passes, and means for introducing sheet material from the reserve roll into the nip responsive to depletion of primary roll sheet material, the improvement wherein the means for introducing the sheet material comprises a lever mounted for rotational movement about a fulcrum, the portion of the lever to one side of the fulcrum comprising a cradle for supporting the primary roll and the portion of the lever to the other side of the fulcrum comprising an element for tucking sheet material from the reserve roll into the nip, the lever being balanced such that when the cradle supports a primary roll that has not been substantially depleted, the tucking element is raised above the nip, and when the primary roll has been substantialyl depleted, the tucking element is lowered to introduce sheet material from the reserve roll into the nip.

2. The improvement of claim 1 wherein the device includes a damper mechanism comprising a cam mounted for pivotal movement, a cam follower engaging the cam and mounted for rotational movement with the tucking element, the cam being positioned such that the cam engages primary roll sheet material as the sheet material is dispensed with the result that the force of the sheet material is transferred by the cam to the cam follower such that the tucking element is maintained in the raised position.

* * * * *